United States Patent [19]

Shimono

[11] Patent Number: 4,632,534

[45] Date of Patent: Dec. 30, 1986

[54] DEVELOPING APPARATUS

[75] Inventor: Mamoru Shimono, Yokohama, Japan

[73] Assignee: Kabushiki Kaisha Toshiba, Kawasaki, Japan

[21] Appl. No.: 661,189

[22] Filed: Oct. 15, 1984

[30] Foreign Application Priority Data

Oct. 19, 1983 [JP] Japan ..... 58-195718

[51] Int. Cl.[4] ..... G03G 15/00

[52] U.S. Cl. ..... 355/3 DD; 355/14 D

[58] Field of Search ..... 355/3 DD, 14 D; 118/656, 657, 658; 340/529; 222/51, DIG. 1

[56] References Cited

U.S. PATENT DOCUMENTS 3,982,830 9/1976 Daniels et al. ..... 355/3 DD
4,074,246 2/1978 Conklin et al. ..... 340/529
4,155,638 5/1979 Blitzer ..... 355/3 DD

FOREIGN PATENT DOCUMENTS 0087569 5/1983 Japan ..... 355/3 DD

*Primary Examiner*—Arthur T. Grimley
*Assistant Examiner*—David Warren
*Attorney, Agent, or Firm*—Cushman, Darby & Cushman

[57] ABSTRACT

A developing apparatus is provided with a developing roller disposed in a casing and carrying a toner on the surface thereof, and a detecting mechanism adapted to detect the amount of the toner in the casing and to deliver an empty signal when the casing is emptied of the toner. The detecting mechanism includes a lever rockable within a vertical plane in the casing and has an elongate body, and a detecting section which is wider than the elongate body and disposed at the distal end to the elongate body to engage the surface of the toner stored in the casing. The lever is adapted to hang by gravity in accordance with the amount of the toner.

17 Claims, 10 Drawing Figures

DEVELOPING APPARATUS

BACKGROUND OF THE INVENTION

The present invention relates to a developing apparatus used in, for example, an electronic copying machine.

Conventionally known as a developing apparatus of this type is an apparatus which comprises a feeder casing for applying a developing agent to the surface of an image bearing member such as a photosensitive drum, and a developing agent supply unit for supplying the developing agent in a hopper to the feeder casing by rotation. This developing apparatus is provided with various toner detecting switches for detecting the amount of developing agent in the hopper. The switches, which are off while the developing agent exists in the hopper, are turned on when the hopper is emptied of the developing agent. Thus, the presence of the developing agent is detected. However, these conventional switches are low in reliability.

SUMMARY OF THE INVENTION

The present invention is contrived in consideration of these circumstances, and is intended to provide a developing apparatus permitting smooth action of empty detecting levers in accordance with the amount of stored developing agent and smooth return of the levers after the supply of the developing agent without adversely affecting the stored developing agent.

In order to achieve the above object, there is provided a developing apparatus comprising: a casing storing a developing agent; a developing agent carrier disposed in the casing and carrying the developing agent on the surface thereof; and detecting means for detecting the amount of the developing agent in the casing and delivering an empty signal when the casing is emptied of the developing agent, said detecting means including a first lever rockable within a vertical plane in the casing and having an elongate body, and a detecting section which is wider than the elongate body and disposed at the distal end of the elongate body to engage the surface of the developing agent stored in the casing, said first lever being adapted to hang by gravity in accordance with the amount of the developing agent.

DETAILED DESCRIPTION OF THE PREFERRED EMBODIMENT

A developing apparatus according to one embodiment of the present invention applied to an electronic copying machine will now be described in detail with reference to the accompanying drawings of FIGS. 1 to 10.

Figure 1:
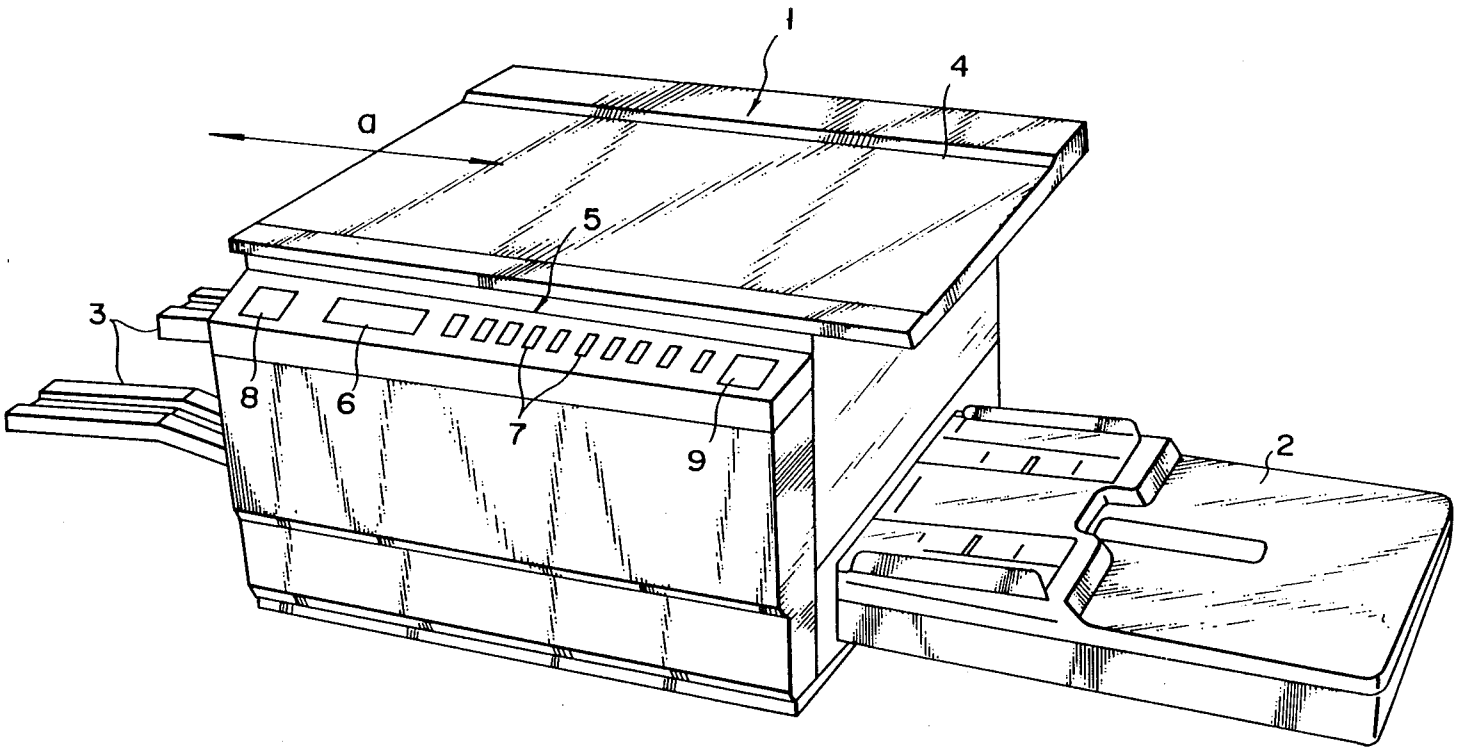
FIG. 1 is a perspective view showing an electronic copying machine incorporating a developing apparatus according to one embodiment of the present invention.

FIG. 1 shows an outline of the electronic copying machine which incorporates the developing apparatus of the one embodiment. In FIG. 1, numeral 1 designates a copying machine housing. A sheet cassette 2 for automatic or manual sheet supply and a sheet receiving tray 3 are attached to the right- and left-hand side portions of the copying machine housing 1, respectively. An original table 4 capable of reciprocating in the longitudinal direction (indicated by arrow a) of the copying machine housing 1 and bearing an original (not shown) thereon is mounted on the top of the housing 1. In FIG. 1, numeral 5 designates a console panel 5 which is provided at the front edge portion of the top face of the copying machine housing 1. The console panel 10 is provided with a display 6, a ten-key unit 7, an exposure volume setter 8, a print key 9, etc.

Figure 2:
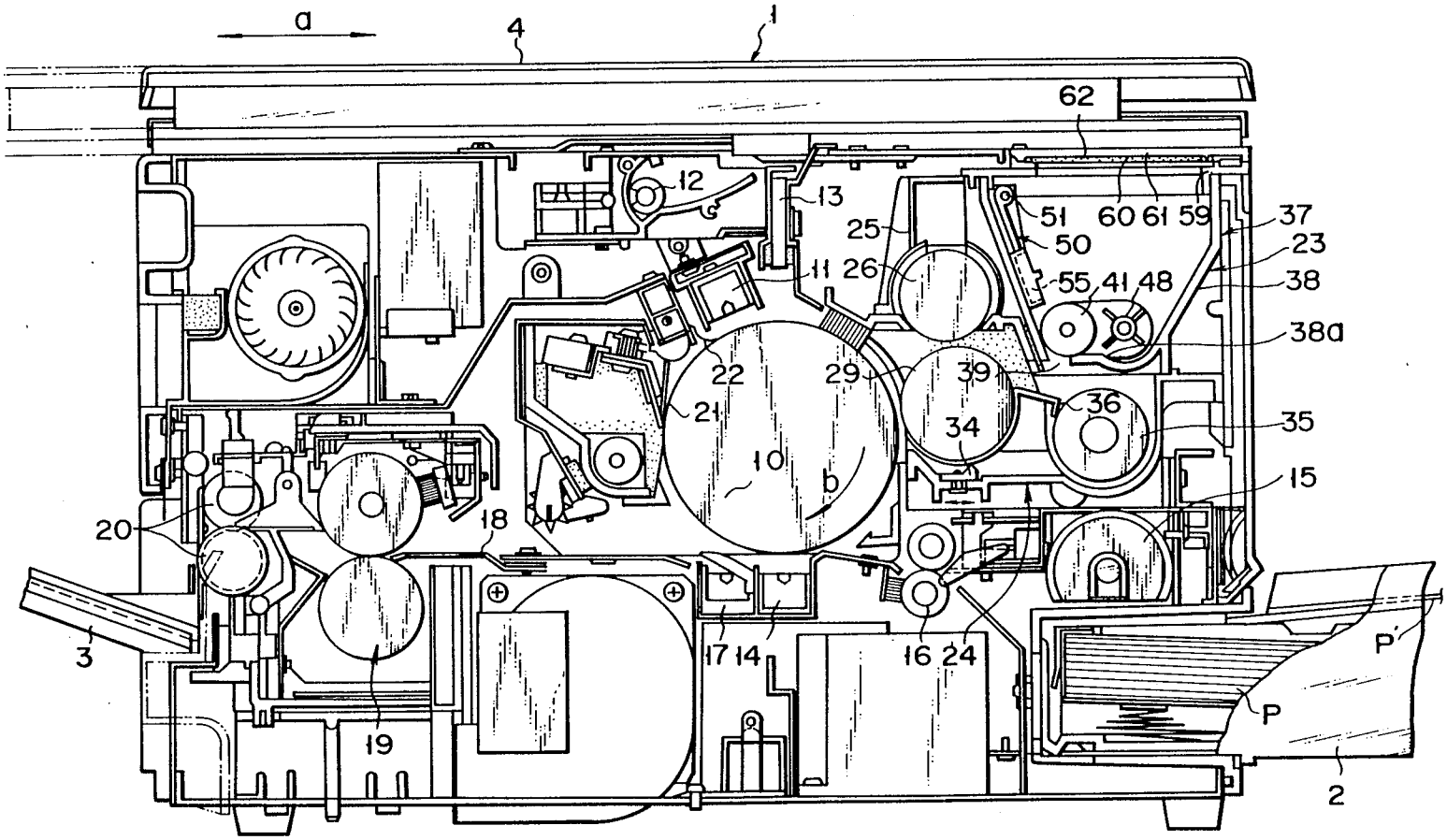
FIG. 2 is a sectional view showing the internal mechanism of the electronic copying machine of FIG. 1.
Figure 3:
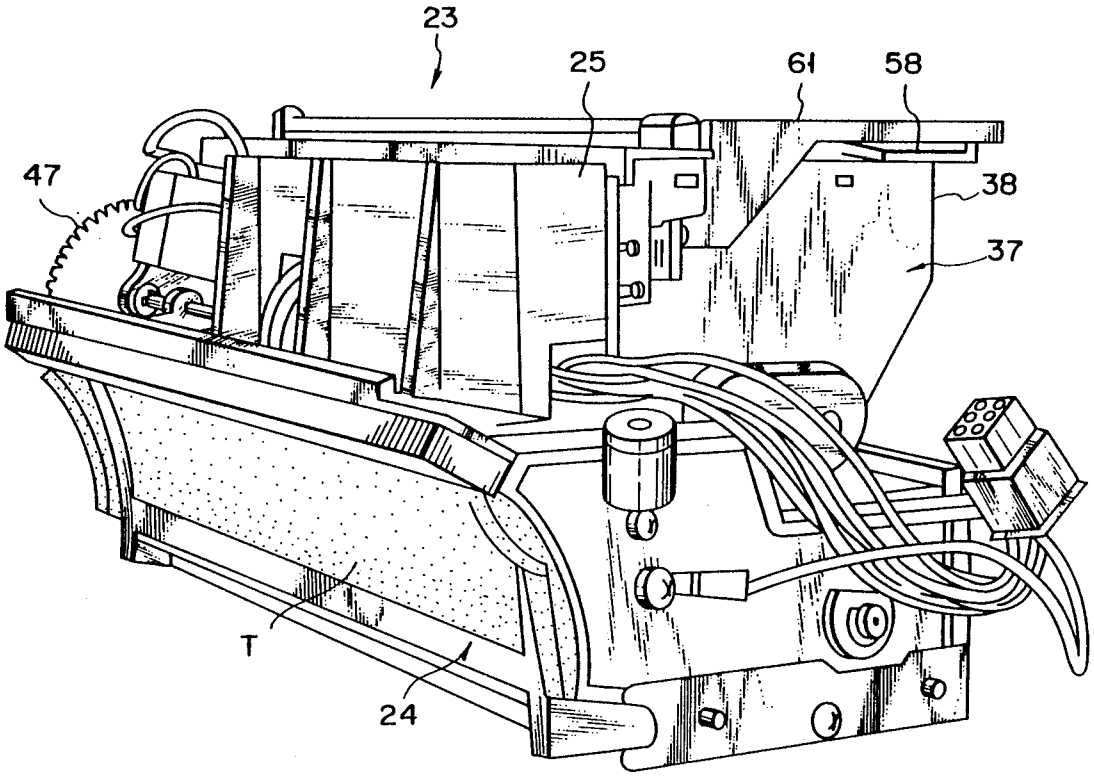
FIG. 3 is a perspective view extractively showing the developing apparatus according to the embodiment of the invention.

Referring now to FIG. 2, the internal mechanism of the copying machine housing 1 will be described.

In FIG. 2, numeral 10 designates a drum-shaped photosensitive body as an image bearing member which is disposed substantially in the central portion of the copying machine housing 1. The photosensitive body 10 can be rotated in the clockwise direction indicated by arrow b in synchronism with the reciprocation of the original table 4 by a drive mechanism (not shown). The photosensitive body 10 is uniformly charged by a charger 11. A reflected light from the original uniformly irradiated by an exposure lamp 12 is projected on the charged photosensitive body 10 through a condensing light transmitter (or Selfoc lens array - trademark) 13. Thus, an electrostatic latent image corresponding to an image impression of the original is formed on the photosensitive body 10. The electrostatic latent image formed in this manner is supplied with a developing agent (hereinafter referred to as toner) to be developed into a developing agent image (hereinafter referred to as toner image) by a developing apparatus 23 mentioned later. Then, the toner image is opposed to a transfer charger 14 as the photosensitive body 10 rotates.

A sheet P or P′ supplied automatically or manually is delivered from the sheet cassette 2 to a transfer section which is defined between the photosensitive body 10 and the transfer charger 14 by means of a sheet feed roller 15 and a pair of aligning rollers 16. In this transfer section, the toner image previously formed on the photosensitive body 10 is transferred to the surface of the sheet P or P′ by the transfer charger 14. After the transfer is ended, the sheet P or P′ is separated from the photosensitive body 10 by a separation charger 17 for discharging AC corona. Thereafter, the sheet P or P′ passes through a conveying path 18 to reach a fixing unit 19, where the toner image is melted and fixed to the sheet P or P′. Then, the sheet P or P′ is discharged into the sheet receiving tray 3 by a pair of exit rollers 20.

After the toner image is transferred to the sheet P or P′, the toner remaining on the photosensitive body 10 is cleared out by a cleaning unit 21. Thereafter, the surface potential of the photosensitive body 10 is lowered below a predetermined level by a discharge lamp 22. Thus, the photosensitive body 10 is ready for the next copying cycle.

Upper and lower frames (not shown) are mounted at one end in the copying machine housing 1 so that they can swing at a designed angle (e.g., 30 degrees) to each other. The upper frame is mounted by suitable means with the photosensitive member 10 and other mechanisms surrounding the same to constitute an upper unit, the mechanisms including the charger 11, the exposure lamp 12, the condensing light transmitter 13, the cleaning unit 21, the discharge lamp 22, and the developing apparatus 23. On the other hand, the lower frame is mounted with the transfer charger 14, the separation charger 17, the fixing unit 19, the exit rollers 20, and other mechanisms (not shown) such as a power source section, constituting a lower unit. Thus, the upper and lower units are designed so that they can be joined together or separated from each other by swinging to conceal or expose the sheet conveying path 19 for the ease of access for repair, inspection and other maintenance work.

As shown in FIG. 1, the developing apparatus 23 is located off to the upper right of the photosensitive body 10. As shown in detail in FIGS. 3 and 4, the developing apparatus 23 is provided with a feeder casing 24 which feeds toner T to the photosensitive member 10 so that the toner T is put on the surface of the photosensitive body 10 in the shape of a brush. A toner density detector 26 is attached to a printed board 25 which is provided at the upper portion of the feeder casing 24. A developing roller 29 is disposed parallel to the photosensitive body 10 in the feeder casing 24, whereby the toner T is applied to the surface of the photosensitive body 10. The developing roller 29 is formed of a non-magnetic rotating sleeve 27 and a fixed magnet roll 28 therein. The toner density detector 26 serves to detect the density of the toner T on the developing roller 29. When the detected value of toner density is lowered below a certain level, a developing agent supply roller 41 of a supply unit 37 (mentioned later) is rotated. Thus, the toner T in the supply unit 37 can be dropped into the feeder casing 24.

Figure 4:
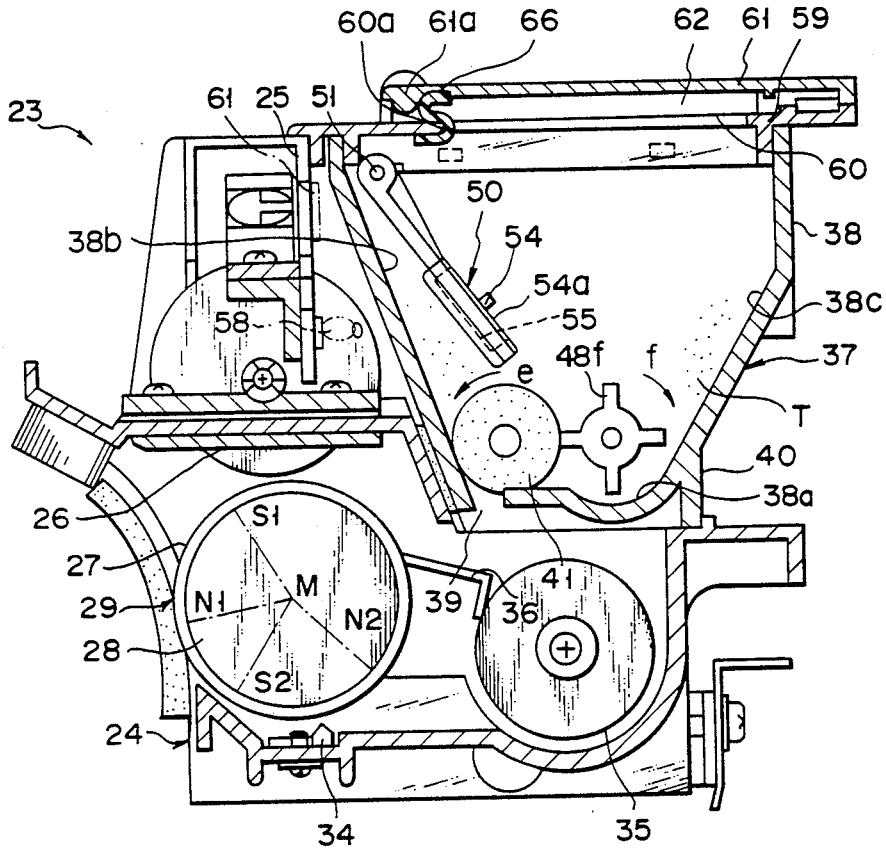
FIG. 4 is a vertical sectional view of the developing apparatus shown in FIG. 3.

As shown in FIG. 4, the developing roller 29 is formed of the so-called sleeve-type developing roller which includes the fixed magnet roll 28 and the rotatable sleeve 27 fitted on the magnet roll 28. The magnet roll 28 has a four-pole roll structure, consisting of a pair of north poles (first north pole N1 of 1,000 gauss and second north pole N2 of 400 gauss) and a pair of south poles (first south pole S1 of 550 gauss and second south pole S2 of 700 gauss) which are arranged at suitable angular intervals around the center M. The magnet roll 28 is designed so that the individual poles are located in the following proper positions relative to the photosensitive body 10.

The poles N1, S1, N2 and S2 of the magnet roll 28 should be positioned as follows. The north pole N1 is positioned 1 to 5 degrees (in the counterclockwise direction) below a straight line connecting the center M of the magnet roll 28 and the center of the photosensitive member 10. The first and second south poles S1 and S2 are positioned so that <N1MS1 in the clockwise direction and <N1MS2 in the counterclockwise direction, with respect to the position of the first north pole N1, are 70 degrees and 50 degrees, respectively. The second north pole N2 is positioned so that <S2MN2 in the counterclockwise direction with respect to the position of the second south pole S2 is 80 degrees.

Figure 5:
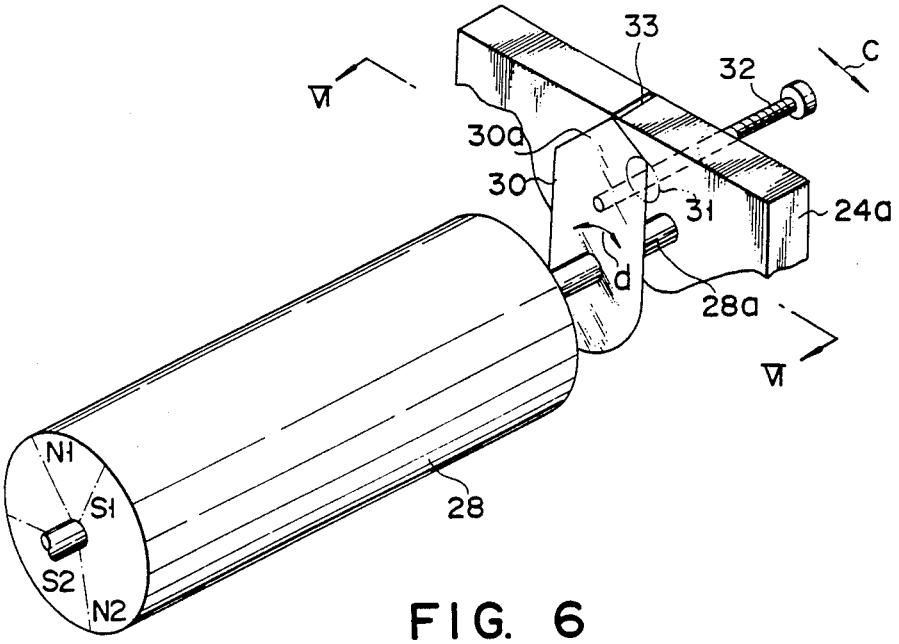
FIG. 5 is a perspective view showing an adjusting mechanism for a magnet roll.
Figure 6:
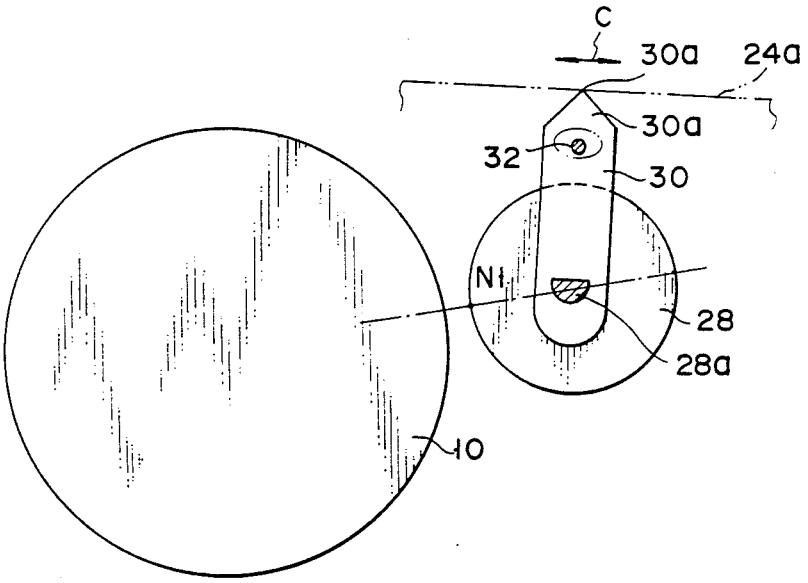
FIG. 6 is a side sectional view of the magnet roll taken along line VI—VI of FIG. 5.

FIGS. 5 and 6 show a specific adjusting unit for finely adjusting the magnet roll 28 to a proper angular position.

In this adjusting unit, one end portion of a shaft 28*a* of the magnet roll 28 is rotatably supported on a frame 24*a* of the feeder casing 24. The shaft 28*a* is provided with a stopper and fitted with an adjusting plate 30. An adjusting bolt 32 is passed through a loose hole 31 in the frame 24*a* from the outside thereof. The tip end of the adjusting bolt 32 is screwed into the adjusting plate 30. A triangular pointer portion 30*a* is formed at one end of the adjusting plate 30. The pointer portion 30*a* is aligned with a mark 33 in the form of a groove in the top face of the frame 24*a*. In this state, the bolt 32 is fixed to the frame 24*a* by using a nut or any other suitable fixing means (not shown). As a result, the roll 28 is prevented from rotating, and the north poles of the roll 28 are located in proper angular positions relative to the photosensitive member 10.

In changing or adjusting the angular position of the roll 28, the bolt 32 is removed from the fixing means. The pointer portion 30*a* is moved crosswise within the range of the loose hole 31, as indicated by arrow c, so that the adjusting plate 30 is rocked as indicated by arrowed. As a result, the roll 28 is also rotated. Thus, when the roll 28 reaches a desired angular position, the bolt 32 is fixed in the aforesaid manner. The displacement of the roll 28 achieved by the adjustment can be detected from a deflection of the pointer portion 45*a* from the reference mark 33. Besides the mark 33, a scale representing the deflection may be provided for this purpose.

Arranged in the feeder casing 24, moreover, are a doctor 34 for regulating the thickness of a toner layer on the developing roller 29, a stirring roller 35 for stirring the toner T, and a scraper 36 whereby the toner T which has not been actually used in development is scraped off the surface of the developing roller 29 and whereby the scraped toner T is fed to the toner lifting side of the stirring roller 35.

The supply unit 37 is removably mounted on the feeder casing 24. The supply unit 37 includes a hopper 38 which stores therein the toner T to be fed into the feeder casing 24. The hopper 38 has a wide inner bottom wall 38*a* with a supply port 39 therein. A support leg portion 40 to be set on the feeder casing 24 protrudes integrally from the peripheral portion of the inner bottom wall 38*a*. The developing agent supply roller 41 is rotatably supported beside the inner bottom wall 38*a*, facing the supply port 39.

Figure 7:
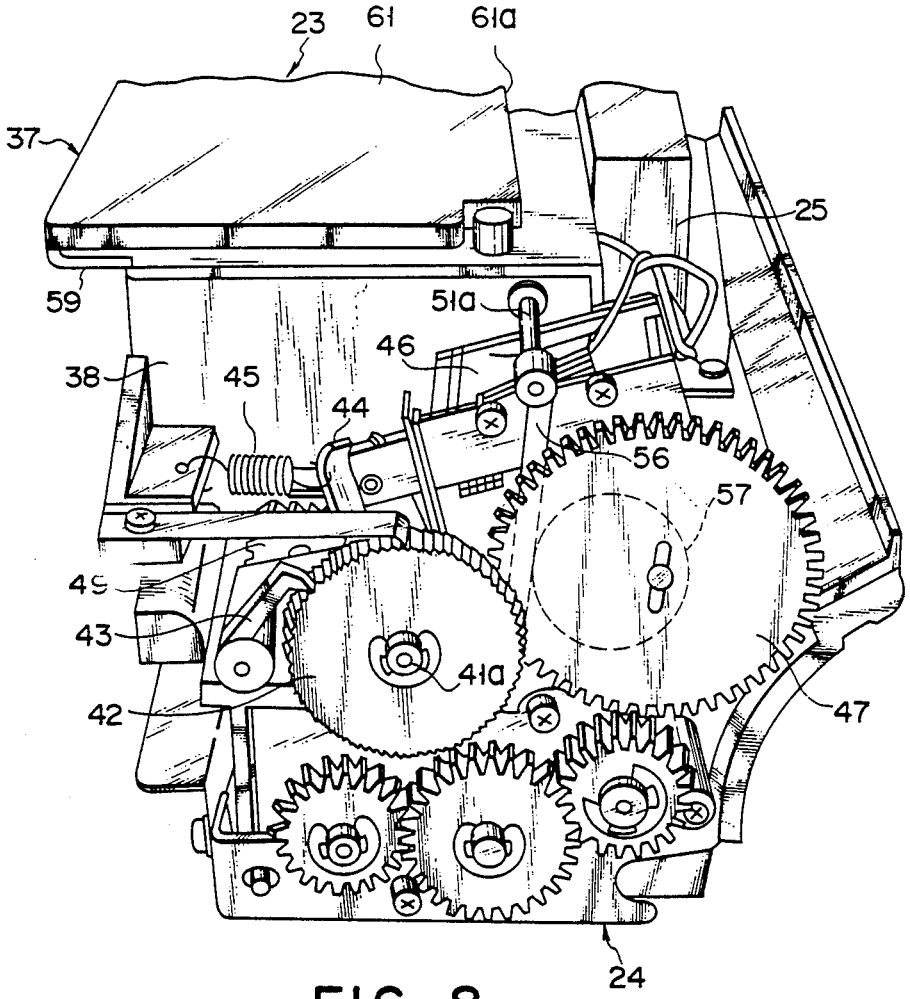
FIG. 7 is a perspective view of the developing apparatus taken from one side.

The supply roller 41 is mounted on a rotating shaft 41*a* which extends outward through the outer side wall of the supply unit 37, as shown in FIG. 7. A ratchet 42 is coaxially fixed on the extended end of the rotating shaft 41*a*. The rotation of the ratchet 42 is regulated by a ratchet retaining mechanism which is formed of a ratchet lever 43, a ratchet link 44, and a spring 45. The ratchet link 44 is driven by a solenoid 46. The ratchet 42 is rotated by the ratchet lever 43 and ratchet link 44. Thus, the toner T is supplied as the solenoid 46 is operated in accordance with a detection signal from the toner density detector 26.

As shown in FIG. 4, a feed roller 48 with stirring blades is rotatably supported on the inner bottom wall 38*a* of the hopper 38, adjoining the supply roller 41 in parallel relation. The feed roller 48 is interlocked with the supply roller 41 by means of a gear 49. These two rollers 41 and 48 are rotated in directions such that the toner T on two opposite slanting inner wall surfaces 38*b* and 38*c* of the hopper 38 is downwardly scraped off, as indicated by arrows e and f of FIG. 4.

Figure 8:
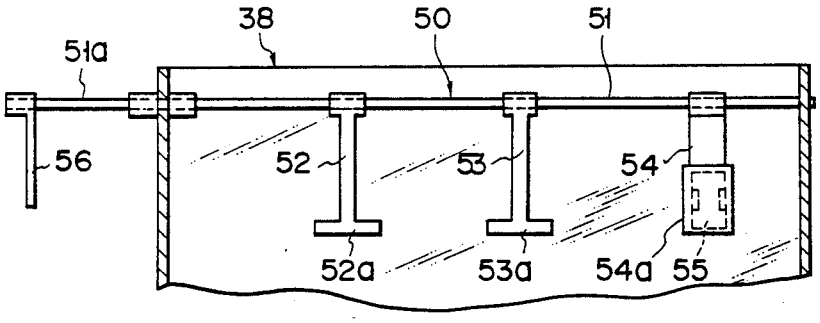
FIG. 8 is a front view showing a toner empty detecting mechanism.

In FIG. 4, numeral 50 designates a toner empty detecting mechanism which is rockably supported on the upper end portion of the slanting inner wall surface 38*b* of the hopper 38 and detects the amount of toner in the hopper 38. As shown in FIG. 8, the detecting mechanism 50 includes a rotatable shaft 51 and a plurality of detecting levers 52, 53 and 54 arranged at spaces on the shaft 51. The detecting levers 52, 53 and 54 are T-shaped, having widened free end portions 52*a*, 53*a* and 54*a*, respectively. The free end portions 52*a*, 53*a* and 54*a* are located over and close to the supply roller 41. A magnet 55 is contained in the free end portion 54*a* of the detecting lever 54. The detecting levers 52, 53 and 54 are rocked to hang down by their own weights depending on the amount of toner in the hopper 38. The shaft 51 has an operating lever 56 on one end portion 51*a* thereof. As shown in FIG. 7, the operating lever 56 extends to the outer peripheral portion of the gear 47 for driving the toner density detector 26. An eccentric cam 57 is coaxially mounted on the gear 47. The free end of the operating lever 56 engages the eccentric cam 57. Thus, as the eccentric cam 57 rotates, the detecting levers 52, 53 and 54 are normally rocked around the shaft 51. The toner T in the hopper 38 is stirred by the detecting levers 52, 53 and 54 rocked in this manner. In FIG. 4, numeral 58 designates a reed switch which is attached to the printed board 25 of the feeder casing 24. The reed switch 58 corresponds in position to the detecting lever 54 of the toner empty detecting mechanism 50 in the hopper 38. The levers 52, 53 and 54 hang down when the hopper 38 is emptied of the toner T. The reed switch 58 is turned on by magnetic action as the magnet 55 in the free end portion 54*a* of the hanging detecting lever 54 approaches the reed switch 58. Thus, the emptiness of the hopper 38 is detected.

Figure 9:
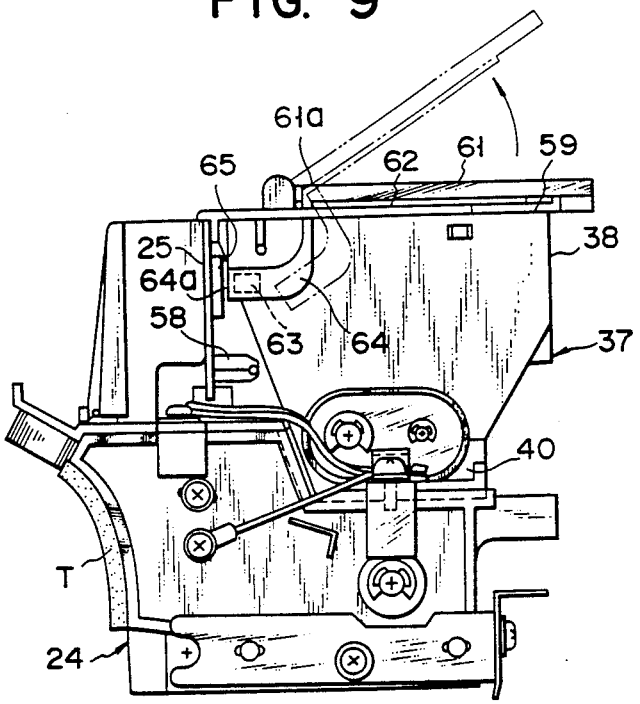
FIG. 9 is a side view of the developing apparatus taken from the other side.

In FIG. 4, numeral 59 designates a hopper cover which covers the top opening of the hopper 38. A toner supply opening 60 is formed in the hopper cover 59. A lid 61 is swingably supported over the supply opening 60. An elastic sealing member 62 made of sponge or the like is pasted on the inside of the lid 61. A pivotal end edge portion 61*a* of the lid 61 faces the printed board 25 of the feeder casing 24. As shown in FIG. 9, an inverted-L-shaped link 64 containing a magnet 63 is attached to one side portion of the supporting end edge portion 61*a* of the lid 61 so that the link 64 can rock together with the lid 61. A reed switch 65 is mounted on that portion of the printed board 25 of the feeder casing 24 which is approached by an end portion 64*a* of the link 64 when the lid 61 is shut down. The reed switch 65 is turned on by magnetic action as the magnet 63 in the link 64 approaches the reed switch 65. Thus, the closure of the toner supply opening 60 is detected.

Figure 10:
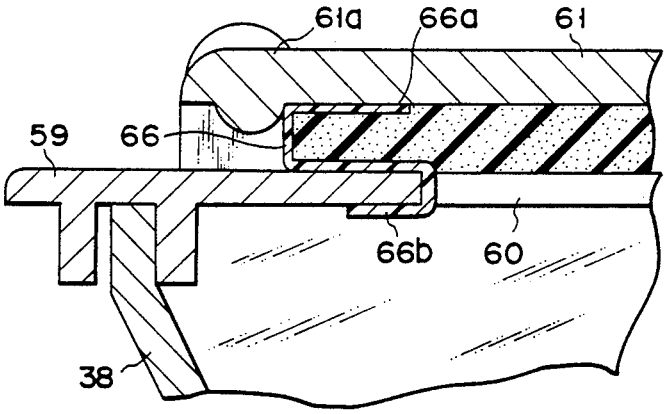
FIG. 10 is a partial enlarged view showing a hopper cover.

As shown in FIG. 10, a sealing member 66 formed of, e.g., a polyester sheet with a thickness of 0.03 to 0.05 mm is interposed between an opening edge portion 60*a* of the supply opening 60 of the hopper cover 59 and the pivotal end edge portion 61*a* of the lid 61. One end portion 66*a* of the sealing member 66 is fixedly held between the lid 61 and the elastic sealing member 62, while the other end portion 66*b* is bent and fixed on the inside of the hopper cover 59 by means of an adhesive agent or the like. Thus, the toner T in the hopper 38 is prevented from scattering to the outside when the lid 61 is swung up and down.

In the arrangement described above, the supply roller 41 and the feed roller 48 are disposed side by side over the inner bottom wall 38*a* of the hopper 38 of the supply unit 37. These two rollers 41 and 48 are rotated in directions such that they downwardly scrape off the toner T along the slanting inner wall surfaces 38*b* and 38*c* of the hopper 38. Thus, the toner T located near the wall surfaces is continually urged to fall down. Although the inner bottom wall 38*a* of the hopper 38 is relatively wide, therefore, the toner T can smoothly be delivered to the side of the supply roller 41 by the feed roller 48 without clinging to the slanting wall surfaces or accumulating one-sidedly.

Having the wide inner bottom wall 38*a* and the supporting leg portion 40 capable of being fitted on the feeder casing 24, the hopper 38 can enjoy an increased capacity. When removed from the feeder casing 24 for toner replacement or other work, moreover, the hopper 38 can stably be placed on the floor. Since the supply roller 41 is housed in the hopper 38 and located above the floor for the height of the supporting leg portion 40, it cannot touch the floor. Thus, the supply roller 41 is prevented from being damaged or distorted or from soiling the floor.

The ratchet retaining mechanism of the supply roller 41, which controls the rotation of the supply roller 41 in accordance with signals from the toner density detector 26 for detecting the density of toner on the developing roller 29, is driven by the solenoid 46, facilitating the control operation.

The toner empty detecting mechanism 50 for detecting the amount of toner in the hopper 38 includes the detecting levers 52, 53 and 54 having the widened distal end portions. Moreover, the detecting levers 52, 53 and 54 are rocked in the direction to leave the toner empty detecting switch 58 as the eccentric cam 57 coaxial with the gear 47 for driving the toner density detector 26 rotates. When the hopper 38 contains therein a sufficient amount of toner, therefore, the toner easily gets into the space between the inner wall surface 38*b* of the hopper 38 and the detecting levers 52, 53 and 54. Thus, the gap between the inner wall surface 38*b* and the detecting levers 52, 53 and 54 can securely be maintained to improve the reliability of the switch 58. Also, the rocking of the detecting levers 52, 53 and 54 by the eccentric cam 57 serves to stir the toner in the hopper 38, further smoothing the delivery of the toner to the side of the supply roller 41.

Furthermore, the toner empty detecting switch 58 and the switch 65 for detecting the swing of the swingable lid 61 of the hopper cover 59 for closing the top end portion of the hopper 38 are mounted on the common printed board 25 on the side of the feeder casing 24. Thus, the components required for the mounting of these switches can be omitted or reduced in number.

What is claimed is:

1. A developing apparatus comprising:

a casing storing a developing agent;

a developing agent carrier disposed in the casing and carrying the developing agent on the surface thereof;

a first lever rockable within a vertical plane in the casing and having an elongate body, and a detecting section which is wider than the elongate body, and disposed at the distal end of the elongate body to engage the surface of the developing agent stored in the casing, said first lever being adapted to hang by gravity in accordance with the amount of the developing agent;

at least a second lever disposed parallel to said first lever so as to be able to rock together with the first lever, said second lever including an elongate body and a detecting section formed on the distal end of the elongate body so as to be wider than the elongate body;

a shaft extending in the horizontal direction and rotatably supported in the casing, said first and second levers being fixed to the shaft;

shaft position sensing means, operatively coupled to the shaft, for sensing the angular portion of the shaft and for producing an empty signal when the shaft moves to a predetermined angular position; and means for reciprocally rotating the shaft periodically between two positions, thereby causing the first lever and the second lever to agitate the developing agent within the casing.

2. The developing apparatus according to claim 1, further comprising:

output means adapted to face the detecting section of the first lever so as to be actuated thereby to deliver an empty signal when the casing is emptied of the developing agent.

3. The developing apparatus according to claim 2, wherein said detecting section includes magnetic force generating means, and said output means is actuated by magnetic force produced by the magnetic force generating means.

4. The developing apparatus according to claim 3, wherein said output means is disposed outside the casing.

5. The developing apparatus according to claim 4, wherein said magnetic force generating means includes a magnet, and said output means includes a reed switch adapted to be turned on by the magnetic force of the magnet.

6. The developing apparatus according to claim 1, which further comprises supply means disposed parallel to the developing agent carrier for rotating within the casing and for supplying the developing agent carrier with the developing agent.

7. The developing apparatus according to claim 6, wherein said supply means includes a rotatable supply roller and driving means for rotating the supply roller.

8. The developing apparatus according to claim 7, wherein said respective driving means for the shaft and the supply means are provided with a common drive source.

9. The developing apparatus according to claim 3, wherein said casing has an opening allowing the developing agent to be fed into the casing and a cover moveable between an open position whereat said opening is open and a closed position whereat said opening is closed.

10. The developing apparatus according to claim 9, which further comprises detecting means for detecting when the cover is in said closed position.

11. The developing apparatus according to claim 10, further comprising:

a second magnetic force generating means attached to the cover, and a second output means, adapted to be actuated by said second magnetic force generating means, for delivering a closing signal when the cover is moved to said closed position.

12. The developing apparatus according to claim 11, wherein said second magnetic force generating means includes a magnet, and said output means includes a reed switch adapted to be turned on by the magnetic force of the magnet.

13. The developing apparatus according to claim 15, which further comprises a common printed board upon which the output means and the second output means are disposed.

14. An apparatus for detecting when a hopper is empty, comprising:

a rotatable shaft disposed within a hopper;

plural rigid levers fixedly mounted to said shaft and all lying within the same plane, each lever including (a) an elongated portion and (b) widened paddle means, terminating said elongated portion, for being supported by the surface of particulate matter disposed in said hopper;

shaft position sensing means, operatively coupled to said shaft, for sensing the angular position of said shaft and for producing an empty signal when said shaft moves to a predetermined angular position; and means for reciprocally rotating said shaft periodically between first and second positions, thereby causing said plural levers to agitate particulate matter within said hopper.

15. An apparatus as in claim 14 wherein said paddle means is integral with and perpendicular to said elongated portion.

16. An apparatus as in claim 14 wherein said plural levers each comprise a flat T-shaped member.

17. An apparatus as in claim 14 wherein said position sensing means includes:

a reed switch disposed in said hopper; and a magnetic member fixedly mounted to said shaft and lying within said plane.

* * * * *